US006879108B1

(12) United States Patent
Ilmer et al.

(10) Patent No.: US 6,879,108 B1
(45) Date of Patent: Apr. 12, 2005

(54) DIELECTRICALLY IMPEDED DISCHARGE LAMP WITH A SPACER

(75) Inventors: Michael Ilmer, Augsburg (DE); Angela Eberhardt, Augsburg (DE); Michael Seibold, München (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/719,986

(22) PCT Filed: Apr. 19, 2000

(86) PCT No.: PCT/DE00/01227

§ 371 (c)(1),
(2), (4) Date: Mar. 15, 2001

(87) PCT Pub. No.: WO00/65635

PCT Pub. Date: Nov. 2, 2000

(30) Foreign Application Priority Data

Apr. 28, 1999 (DE) ..... 199 19 363

(51) Int. Cl.[7] ..... H01J 29/87
(52) U.S. Cl. ..... 313/600; 313/36
(58) Field of Search ..... 313/607, 50, 324, 313/62, 71, 260, 334, 634, 343, 36, 338, 638, 345

(56) References Cited

U.S. PATENT DOCUMENTS

| | | | | |
|---|---|---|---|---|
| 3,734,702 A | * | 5/1973 | Veres | 65/43 |
| 4,945,281 A | | 7/1990 | Ipson | |
| 6,049,086 A | | 4/2000 | Foggiato et al. | |
| 6,531,822 B1 | * | 3/2003 | Vollkommer et al. | 313/634 |

FOREIGN PATENT DOCUMENTS

| | | |
|---|---|---|
| DE | 198 17 480 | 9/1999 |
| EP | 324 953 | 12/1988 |
| EP | 363 832 | 10/1989 |
| WO | 98/43277 | 10/1998 |
| WO | 99/54916 | 10/1999 |

* cited by examiner

*Primary Examiner*—Nimeshkumar D. Patel
*Assistant Examiner*—Ken A Berck
(74) *Attorney, Agent, or Firm*—Robert F. Clark

(57) ABSTRACT

A discharge lamp, suitable for operation by means of dielectrically impeded discharge, having a discharge vessel with two at least partially parallel vessel walls (2; 7), and at least one spacer (1) made from optically transparent insulating material. The or each spacer (1) is in contact with the two vessel walls (2; 7) via bearing surfaces. The or each spacer has an optically diffuse surface (8) at least in the region of one bearing surface.

8 Claims, 3 Drawing Sheets

DIELECTRICALLY IMPEDED DISCHARGE LAMP WITH A SPACER

TECHNICAL FIELD

The invention proceeds from a discharge lamp in accordance with the preamble of claim 1.

Here, the term "discharge lamp" covers sources of electromagnetic radiation based on gas discharges. The spectrum of the radiation can in this case comprise both the visible region and the UV (ultraviolet)/VUV (vacuum ultraviolet) region as well as the IR (infrared) region. Furthermore, it is also possible to provide a fluorescent layer for converting invisible into visible radiation.

Discharge lamps having so-called dielectrically impeded electrodes are also concerned. Here, the dielectrically impeded electrodes are typically implemented in the form of thin metallic strips which are arranged on the outer and/or inner wall of the discharge vessel. If all the electrodes are arranged on the inner wall, at least some of these electrodes must be completely covered from the interior of the discharge vessel by a dielectric layer. Discharge lamps of this type are usually denoted as dielectrically impeded discharge lamps or dielectric barrier discharge lamps, sometimes also as silent discharge lamps, and are disclosed, for example, in EP 0 363 832 (FIG. 3) and WO 98/43279 (FIGS. 3*a*, 3*b*).

More precisely, the invention relates to the abovenamed type of lamp having a large-area discharge vessel, in particular so-called flat lamps. Such lamps typically have two, at least partially and approximately plane, discharge vessel walls which are adjacent to one another in parallel.

These two vessel walls, referred to below for shortness as front plate and baseplate respectively, are usually connected to one another in a gas-tight fashion via a frame, and thereby form the discharge vessel. Alternatively, the baseplate and/or front plate can be shaped such that a discharge vessel is formed as soon as they are joined. For example, the baseplate and/or front plate can be shaped like a trough, for example by deep drawing of a plane glass plate. In the case of flat lamps of very large area, the predominant fraction of the shaped baseplate or front plate is at least approximately plane in this case as well. In this case such a lamp requires, for stabilization purposes, one or more support points, also denoted as spacers below.

This holds all the more so since a discharge lamp contains a gas filling of defined composition and filling pressure, and must therefore be evacuated before the filling. Consequently, the discharge vessel must permanently resist both underpressure—specifically during the production of the lamp—and the later filling pressure which, in the case of such a lamp, is usually less than atmospheric pressure, for example between 10 kPa and 20 kPa. This is achieved by means of the said spacers, which are arranged between the baseplate and front plate of the discharge vessel in sufficient numbers and in a suitable position. Each spacer rests in this case on two mutually opposite bearing surfaces of the two plates, and thus supports the latter against one another. The positioning of the spacers must be performed in such a way that the discharge, which burns in the form of numerous partial discharges in a fashion essentially parallel to the baseplate of the plane discharge vessel, is not influenced, or is influenced only slightly at most. For this reason, and in order to impair as little as possible the luminance on the front plate of the plane discharge vessel, the extent of the bearing surface of each spacer is kept as small as possible, in any case to the extent ensuring a reliable support function of the spacers.

PRIOR ART

Document EP 0 324 953 A1 discloses a flat radiator having dielectrically impeded electrodes and spacers (for example FIG. 1). The spacers are formed by elongated distance pieces made from insulating material.

Also known, moreover, are spacers of different shapes, for example in the form of columns or spheres. Different cross-sectional shapes are conceivable in the case of a column. In any case, the individual spacers are usually brought to the desired dimensions by grinding and polishing. It is disadvantageous in this case that these spacers are reflected as relatively dark spots in the luminous front plate of the lamp.

SUMMARY OF THE INVENTION

It is the object of the present invention to provide a discharge lamp in accordance with the preamble of claim 1, in which the spacers are visible as little as possible.

This object is achieved by means of the characterising features of claim 1. Particularly advantageous embodiments are to be found in the dependent claims.

According to the invention, the or each spacer is provided with an optically diffuse surface at least in the region of one bearing surface. Alternatively, the entire surface of the or each spacer can also be provided with a diffuse surface.

The diffuse surface can be implemented by frosting, for example by etching using hydrofluoric acid, by sand blasting or the like. Or alternatively, the diffuse surface can also be implemented by a thin frosted-white coloured layer.

It is advantageous, in addition, when the area of the bearing surface is as small as possible so that the latter can be detected as little as possible by comparison with the extent of the front plate. However, the bearing surface should not be minimised in such a way that it is to be regarded as being quasi-puntiform in the extreme case, since this could increase impermissibly local loading of the discharge vessel plates. Rather, the bearing surfaces which have proved themselves are those which support a relatively large surface despite a small area, for example cruciform bearing surfaces. The arms of the cross are preferably of relatively narrow design by comparison with a rectangle, which can be regarded as defined by the cross.

A particular problem is added when the or each spacer is formed by a body which has a thickened portion between the two bearing surfaces, for example a polished sphere. Specifically, it has proved that in this case, during operation of the lamp, each bearing surface is imaged as a dark "point" on the front plate of the lamp. A dark aureole appears around this "point". The cause of this seems to be the casting of the shadow of the sphere against the inner wall of the front plate.

According to the invention, at least the bearing surface of the sphere is frosted. Moreover, the upper hemisphere of the sphere, that is to say that hemisphere whose pole lies inside the bearing surface of the sphere with the inner wall of the front plate, is additionally coated with fluorescent material. However, the bearing surface itself is excluded from the fluorescent material, or the fluorescent layer is at least thinner on the bearing surface. Evidently, the fluorescent layer on the "upper" hemisphere of the sphere reflects or scatters light into the region shaded by the sphere, thus avoiding the abovenamed dark aureole. The uncoated "lower" hemisphere, by contrast, allows the sphere to be entered by light which partly passes out of the bearing surface and through the front plate, thus preventing the production of the abovenamed dark "point" on the front plate.

In a development, the surface of the or each spacer is treated in such a way that the or each relevant surface, possibly with the exception of the bearing surface, has the properties of a "radiation trap". What is meant by this is that the optical properties of the respective surface are specifically varied in such a way that the light beams impinging on this surface are preferably refracted into the relevant spacer and in so doing contribute to lighting this spacer.

This can be achieved, for example, by a multiplicity of suitable microstructures, in particular in the form of prisms or pyramids, on the surface of the or each spacer. The effect of the radiation trap is based in this case on the fact that some of the light beams reflected by a structure impinge on an immediately adjacent structure and are refracted at least partially by this structure into the relevant spacer.

Alternatively, the effect of the radiation trap can also be achieved by a type of anti-reflection interference layer which is applied to the surface of the or each spacer. However, this variant is technically complicated, since interference layers are typically implemented by a stack of thin layers of alternately high or low refractive index.

The material of the spacers consists in each case of optically transparent material, for example glass. Only then are the light beams injected into the spacers capable of passing through the latter at all, that is to say of re-emerging from the spacers without unacceptably high losses, and thereby contributing to lighting it up. As a result, the spacers on the front plate can be detected as little as possible, that is to say the homogeneity of the luminance distribution on the front plate is impaired as little as possible.

Protection is also claimed for such a spacer whose surface is at least partially optically diffuse.

DESCRIPTION OF THE DRAWINGS

The invention is to be explained in more detail below with the aid of a plurality of exemplary embodiments.

In the drawings:

FIG. 1 shows a schematic illustration of the arrangement of spacers 1 in a typical electrode configuration of a flat radiator lamp for background lighting of a liquid crystal display screen (not illustrated), in relation to which further reference is made to document WO 98/43276. Elongated anodes 3 and cathodes 4 are arranged alternately on the baseplate 2. The cathodes 4 have nose-like projections 5 (cf. WO 98/11596), at which a partial discharge forms in each case during operation. Moreover, each anode 3 is completely covered by a dielectric layer (not illustrated). An indication is given for a frame 6 of the discharge vessel which connects the baseplate 2 to a front plate (not illustrated) in a gas-tight fashion, thus forming a discharge vessel. The light from the flat radiator lamp is coupled out essentially through the front plate.

FIG. 2 illustrates the spacers 1 in a detailed and cross-sectional illustration from FIG. 1. Identical features are provided with identical reference numerals. The spacer 1—a precision glass sphere made from soft glass with a diameter of 5 mm—is situated between the baseplate 2 and the front plate 7 of the flat radiator lamp. The entire surface 8 of the sphere 1 is etched in a frosted fashion by means of hydrofluoric acid.

Figure 1:
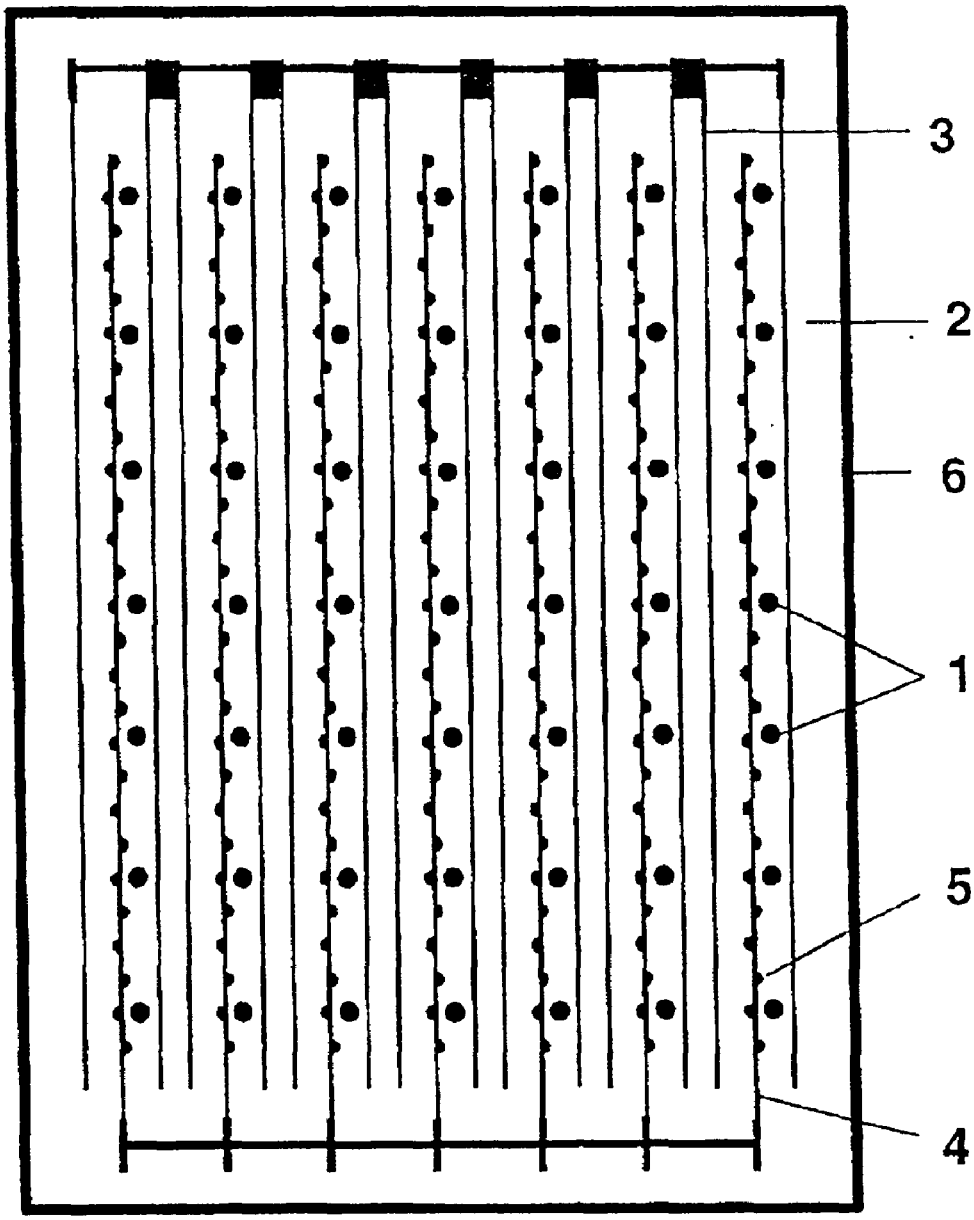
FIG. 1 shows the arrangement of spacers in a typical electrode configuration of a flat radiator lamp.
Figure 2:
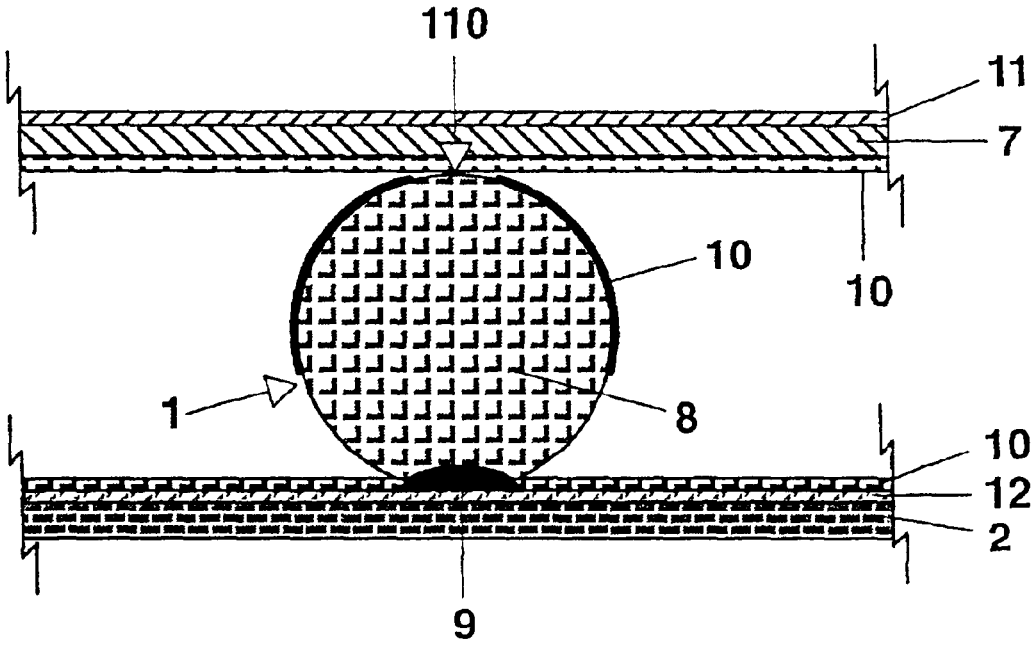
FIG. 2 shows a spacer in a detailed and cross-sectional illustration from FIG. 1.

The glass sphere 1 is soldered to the baseplate 2 via a glass solder 9, in order to fix it during mounting. The glass solder 9 is preferably mixed with a white pigment, for example with approximately 1 to 10 percent by weight (% by weight) of rutile ($TiO_2$), in order to prevent the glass sphere 1 from projecting a possibly dark colour of the glass solder 9 to the front plate 7. It is only the glass sphere 1 which bears against the front plate 7 itself.

With the exception of a small area 110 around the bearing surface of the sphere 1 on the front plate 7, the "upper" hemisphere of the glass sphere 1 adjacent to the front plate 7 is coated with a fluorescent layer 10 which is also located on the baseplate 2 and on the front plate 7.

A prismatic foil 11 (brightness enhancement foil from the 3M), is situated on the outside of the front plate 7, which consists of transparent special glass B270 from the DESAG company.

A reflection layer 12 is also located on the baseplate 2 below the fluorescent layer 10.

Figure 3A:
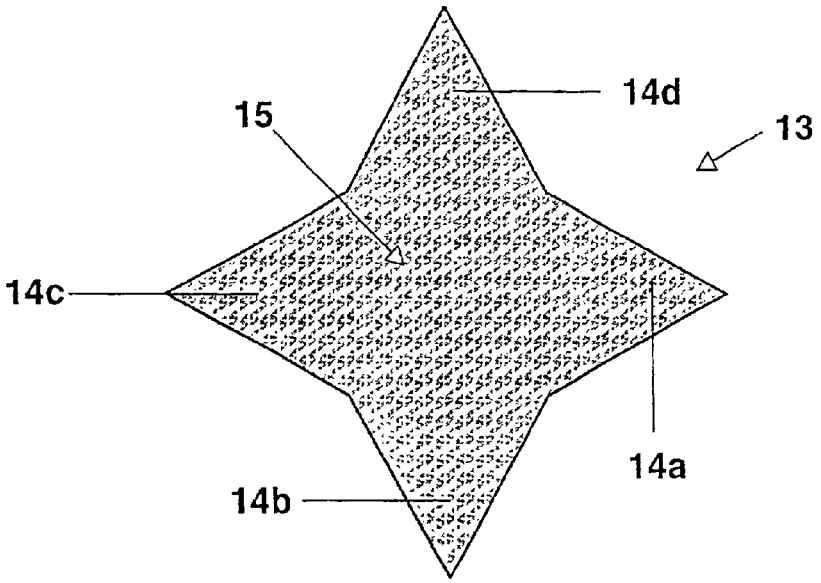
FIG. 3*a* shows a further exemplary embodiment of a spacer, in top view.
Figure 3B:
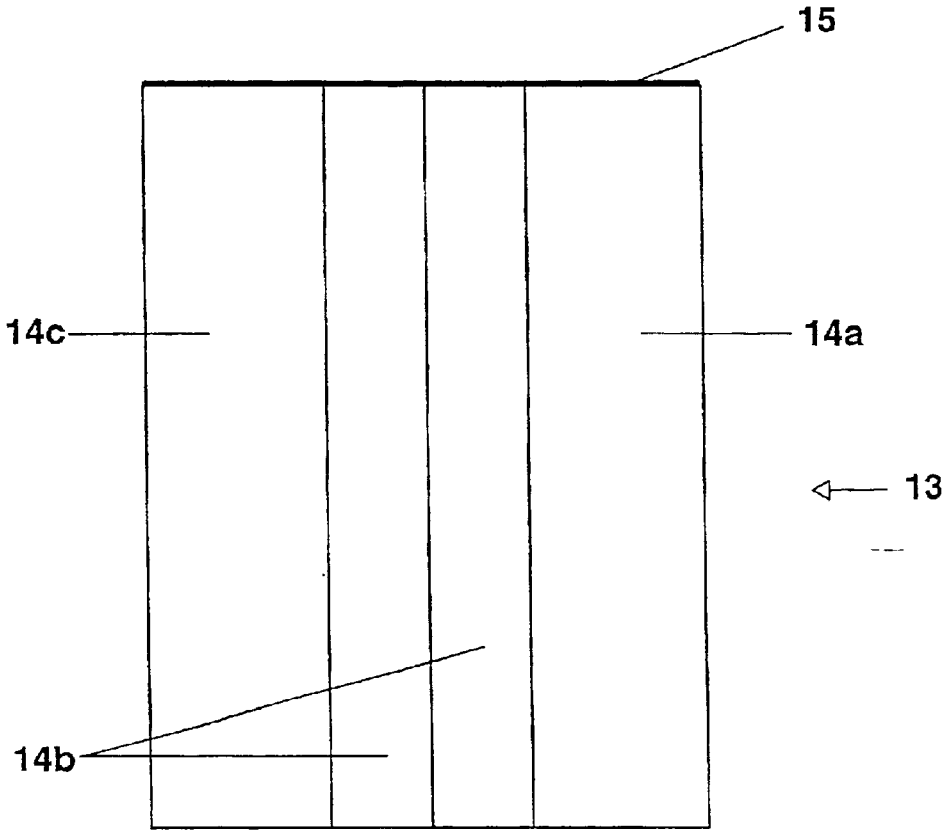
FIG. 3*b* shows the spacer from FIG. 3*a* in a side view.

FIGS. 3*a*, 3*b* show diagrammatically a further exemplary embodiment of a spacer 13, in a top view and in a side view. This is a glass column having a star-shaped cross section, the star having four arms 14*a*–14*d*. The upper end face of the glass column 13 is provided with a frosted-white coloured layer 15.

However, glass columns with a cruciform cross section have also proved themselves (not illustrated), in particular those having arms of a cross which are narrow by comparison with the surface defined.

In a variant (not illustrated) of FIG. 1, each glass sphere 1 is replaced by such a glass column 13. In this case, the upper end face or the coloured layer 15 respectively forms the bearing surface with the front plate 7 of the discharge vessel of the lamp.

The advantageous effect of the invention is not limited to the forms of the spacers set forth in the exemplary embodiments.

What is claimed is:

1. A dielectrically impeded discharge lamp comprising a discharge vessel having electrodes and two at least partially parallel vessel walls comprising a front plate and a base plate, at least one electrode being separated from the interior of the discharge vessel by a dielectric;

a spacer made from an optically transparent insulating material and having a spherical shape, the spacer having an optically diffuse surface and being arranged inside the discharge vessel between the two vessel walls and in contact with the two vessel walls via bearing surfaces; and one hemisphere of the spacer being coated with a fluorescent material, the coated hemisphere being oriented in such a way that its pole lies inside the bearing surface with the front plate, the other hemisphere of the spacer not being coated with a fluorescent material.

2. The discharge lamp according to claim 1 wherein the coating of fluorescent material is at least thinner on the bearing surface with the front plate.

3. The discharge lamp according to claim 1 wherein at least a portion of the surface of the spacer has microstructures, the microstructures being in the form of prisms or pyramids.

4. The discharge lamp according to claim 1 wherein at least a portion of the surface of the spacer has an anti-reflection interference layer.

5. The discharge lamp according to claim 1 wherein at least one bearing surface of the spacer is connected to a vessel wall by a glass solder containing a white pigment.

6. The discharge lamp according to claim 5 wherein the white pigment is rutile ($TiO_2$) and the proportion of the white pigment in the glass solder is in the range from approximately 1% by weight to 10% by weight.

7. The discharge lamp according to claim 1 wherein the diffuse surface is implemented by frosting.

8. The discharge lamp according to claim 1 wherein the diffuse surface is implemented by a thin frosted-white colored layer.

* * * * *